United States Patent [19]

Van Perlstein et al.

[11] Patent Number: 5,042,564

[45] Date of Patent: Aug. 27, 1991

[54] METHOD FOR THE MANUFACTURE OF FORMABLE STEEL

[75] Inventors: Erik B. Van Perlstein; Robert F. Gadellaa, both of Beverwijk; Huibert W. Den Hartog, Noordwijkerhout, all of Netherlands

[73] Assignee: Hoogovens Groep B.V., Ijmuiden, Netherlands

[21] Appl. No.: 438,040

[22] Filed: Nov. 20, 1989

[30] Foreign Application Priority Data

Nov. 24, 1988 [NL] Netherlands ..... 8802892

[51] Int. Cl.[5] ..... B22D 11/00

[52] U.S. Cl. ..... 164/476; 164/477; 148/2

[58] Field of Search ..... 164/476, 477, 76.1; 148/2

[56] References Cited

U.S. PATENT DOCUMENTS 3,969,162 7/1976 Henke .
4,885,041 12/1989 den Hartog et al. ..... 148/2

FOREIGN PATENT DOCUMENTS 112027 6/1984 European Pat. Off. .
194118 9/1986 European Pat. Off. .
196788 10/1986 European Pat. Off. .
226446 6/1987 European Pat. Off. .
306076 3/1989 European Pat. Off. .

OTHER PUBLICATIONS

Patent Abstracts of Japan, vol. 9, No. 211 (C-300) (1934) 8/29/85, K. Oosawa, "Production of Cold-Rolled Steel Plate for Drawing".
Patent Abstracts of Japan, vol. 10, No. 276 (C-373) (2332) 9/19/86, H. Suzuki, "Manufacture of Cold Rolled Steel Sheet for Press Working . . . ".
Patent Abstracts of Japan, vol. 10, No. 98 (C-339) (2155) 4/15/86, H. Katou, "Manufacture of Nonaging Cold Rolled Steel Plate by . . . ".

*Primary Examiner*—Kuang Y. Lin
*Attorney, Agent, or Firm*—Stevens, Davis, Miller & Mosher

[57] ABSTRACT

In the manufacture of formable steel in the form of a strip with a final thickness of between 0.5 and 1.5 mm, in a number of continuous successive process stages, molten steel is continuously cast into a slab of less than 100 mm thickness and the slab is rolled into the strip. To simplify the apparatus required, and improve process control, the slab is cooled down to a rolling temperature of between 300° C. and a temperature $T_t$ at which at least 75% of the material is converted into ferrite, and the rolling of the slab into strip comprises at least one reduction stage with a thickness reduction of over 30%. The rolling exit speed is less than 1000 m/min. After recrystallization, the strip is coiled.

16 Claims, 2 Drawing Sheets

METHOD FOR THE MANUFACTURE OF FORMABLE STEEL

Figure 1:
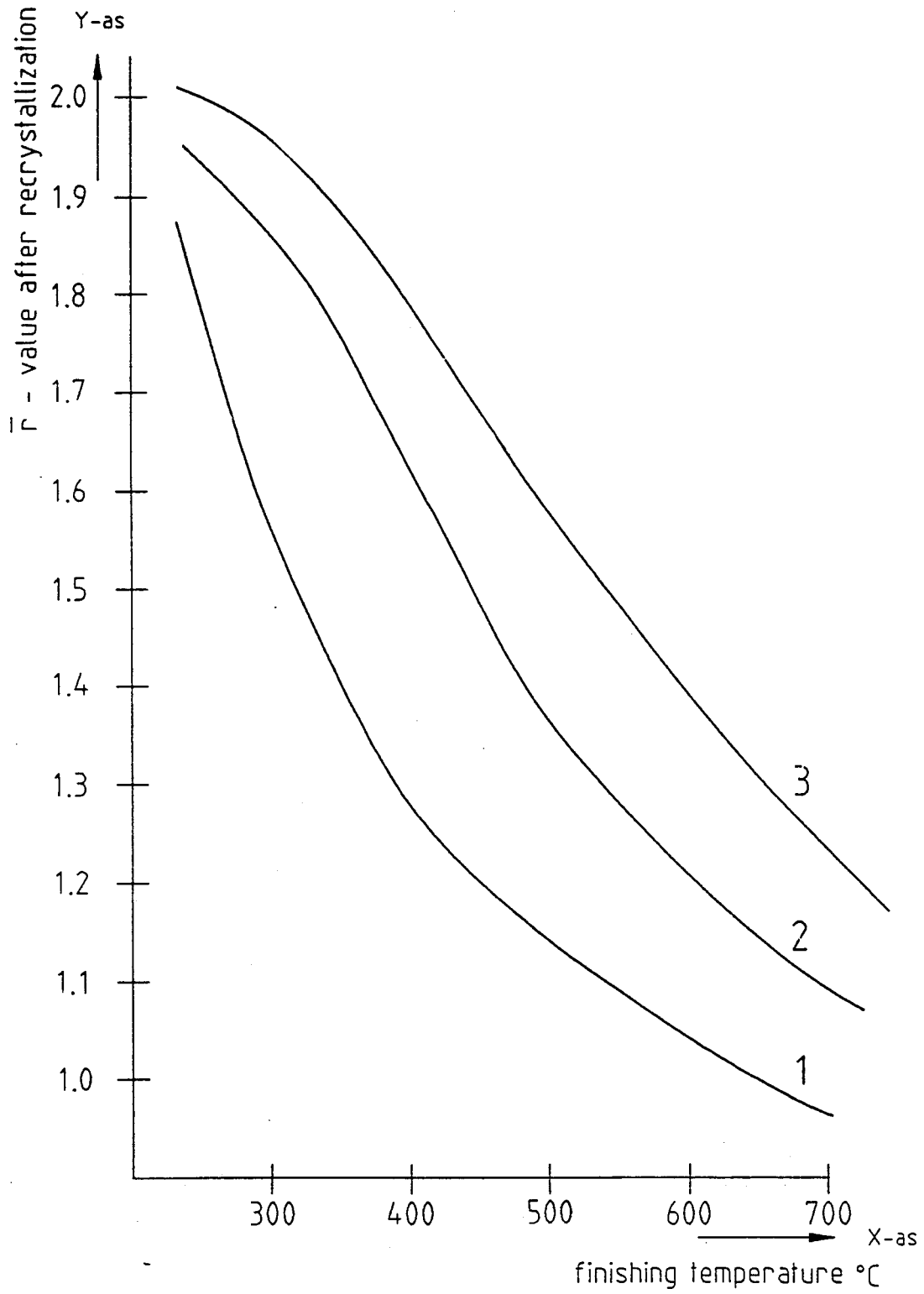

The invention relates to a method for the manufacture of formable steel in the form of a strip with a thickness of between 0.5 and 1.5 mm, in which in a number of continuous successive process stages, molten steel is continuously cast into a slab of less than 100 mm thickness and the slab is rolled into the strip. The invention also relates to strip manufactured by this method.

By 'continuous successive process stages' is meant process stages which during normal operation are carried out simultaneously on one and the same original slab, including the continuous casting of the slab.

By 'formable steel' is meant a type of steel which is suitable for plastic shaping or deformation, including deep drawing, and is thus particularly suitable for use in construction industry components, automotive structures, especially car bodywork, household applicances, office furniture, containers and generally in products for which appearance is important.

A method of the type described above is disclosed in Ep-A-306076 (published Mar. 8 , 1989). This describes a method in which in a continuous process a slab is continuously cast and in the austenitic range is rolled out into a sheet with a thickness of between 2 and 5 mm at a temperature below 1100° C. In a process stage following the austenitic rolling the sheet is then cooled down to a temperature of between 300° C. and $T_f$ and then with a thickness reduction of at least 30% rolled out and coiled. Annealing, pickling and coating may be interposed between rolling out and coiling.

This continuous process offers a number of advantages with respect to the classic discontinuous method for making formable steel in which the continuous casting of a slab, hot rolling, pickling, cold rolling, annealing and coating are process stages separate from one another.

Because the different process stages in the continuous process described follow one onto another, problems associated with the start and the end of each individual process stage of the discontinuous method are eliminated. One of the advantages attained is that the temperature of the steel during all process stages can be better controlled and that as a result the precision of shape and the homogeneity of the metallurgical properties of the strip are improved.

The continuous process described also produces significant economic advantages. All components of an apparatus for carrying out the continuous process described may work continuously because run-in and run-out phases and waiting times are eliminated. This means that optimum use is made of the components so that production is even possible at a lower production level per component than is currently considered technically and economically accountable in the steel world. Apparatus control too may be centralized and carried out more easily.

In the continuous process described, the initial thin slabs have a thickness of less than 100 mm. A continuous casting machine for such slabs is many times lighter and less expensive than a continuous casting machine for slabs with a thickness of 250 mm. Therefore, the method described is of particular interest for medium sized and small steelworks.

All in all the continuous process described is consequently already far more economically and technically attractive for a production level required under today's standards than a discontinuous process.

One inconvenience of the continuous process described is the rigid separation between rolling in the austenitic range and rolling in the ferrite range in order to prevent any so-called 'dual-phase' rolling. For this reason the apparatus used to carry out the process is, in practice, complicated. In order to deal with the separation in practice, a complicated mill stand, a so-called planetary mill stand is proposed. Such a mill stand has disadvantages with respect to thickness control, maintenance and noise making.

The object of the present invention is to provide an improved method in which the advantages of a continuous method, e.g. as described in EP-A-306076 are preserved but which may be carried out by simple apparatus.

The method in accordance with the invention is characterized in that the slab is cooled down to a rolling temperature of between 300° C. and a temperature $T_f$ at which at least 75% of the material is converted into ferrite, in that the rolling of the slab into strip comprises at least one reduction stage with a thickness reduction of over 30%, with an exit speed after hot rolling of less than 1000 m/min, and in that after recrystallisation the strip is coiled. The temperature $T_f$ at which at least 75% of the material converts to ferrite has a relation to the carbon content satisfying the equation $T_f$ (° C.)=(910−890)×(%C.).

The invention is based on the assumption that the structure desired for the strip of formable steel can also be obtained by rolling only in the ferrite temperature range and thereby by means of a reduction of over 30% breaking down the undesired casting structure. In addition, the capacity match between continuous casting machine and mill stands may be preserved by the further assumption that the desired metallurgical properties, and here in particular a desired r-value, may also be obtained at low rolling speeds, and at the forming rates therefore occurring in practice, by rolling in a specific temperature regime within the above-mentioned range.

For the desired capacity match between the mass flow density in the continuous casting machine and the mass flow density in the mill train, an exit speed from rolling lower than 1000 m/min is sufficient.

The method in accordance with the invention produces the significant advantage that it is possible to avoid a rolling stage with a mill stand, enabling a large reduction in a very short time. In particular use of a planetary mill stand is avoided.

Another advantage of the method in accordance with the invention is that the entry temperature of the slab into the mill stands is lower than with the method of EP-A-306076. This prevents the slab from heating up the rolls of the mill stand and the rolls from wearing quickly having softened under the heat. Another advantage is obtained because scale formation at low entry temperature is slight, which makes it easier to produce a strip with a flawless surface quality.

It is to be noted that EP-A-0194118 discloses a method for manufacturing formable steel, in which a low carbon steel undergoes at least one rolling stage in the temperature range between 300° C. and 800° C. at a forming rate of not less than 300 per second and is thereafter recrystallisation annealed. This publication only mentions the conditions for carrying out a rolling stage for obtaining a formable steel with desired properties, but does not mention the manufacture of formable steel in a continuous process in accordance with the present invention. The proposed high forming rate of over 300 per second hinders the use of the proposed method in a continuous process because of the incompatibility with a continuous casting machine used in practice in a production line.

It is also to be noted that a method disclosed in EP-A-0196788 for manufacturing formable steel, in which a low carbon steel undergoes at least one rolling stage in the temperature range between 500° C. and the Ar3-point, at a reduction of not less than 35% and a forming rate of not less than 300 per second. This publication too only mentions the conditions for carrying out one single rolling stage for obtaining a formable steel with desired properties. It does not mention the manufacture of formable steel in a continuous process. Also, for the rolling stage of this publication, the proposed high forming rate is not compatible with the casting rate of a continuous casting machine used in practice in a production line.

The method in accordance with the invention assumes that the desired properties of the formable steel may also be attained with a method in which a lower strip exit speed and, associated with that, a lower forming rate is used, and in which in combination with a lowering of the temperature and subsequent recrystallisation, the desired properties and in particular a desired r-value are obtained. This is explained as follows. The r-value (Lankford value) is proportional to the ratio between the amount of material with a 111 crystal orientation and the amount of material with a 100 crystal orientation. In recrystallisation, there appear in time first the nuclei of the 111 crystal orientation and later the nuclei for the 100 crystal orientation.

$$\text{Forming rate} = \frac{2\pi n}{60\sqrt{r}} \cdot \sqrt{\frac{R}{H_0}} \cdot \ln\left(\frac{1}{1-r}\right)$$

wherein r=draft %/100, R=roll radius in (mm) and $H_o$=thickness before rolling (mm).

Deformation of steel brought about by a rolling process causes dislocations in the steel which are the driving force for recrystallisation. For a high r-value it is important that as much as possible of this driving force be used for the crystals with 111 orientation. So a fast recrystallisation is beneficial for forming a large number of crystals with 111 texture, and thus for a high r-value. However, the driving force may also disappear by another phenomenon, the so-called recovery. Recovery is a process whereby dislocations disappear as a result of thermal movement in the crystal lattice, for example at the grain boundaries. The occurrence of recovery reduces the remaining driving force for recrystallisation, and so has a negative effect on the r-value. Recovery is a process defined by temperature and the passage of time. Thus recovery may be suppressed by reducing the time in which recovery may occur and dislocations be destroyed, at the sacrifice of nuclei for recrystallisation. This assumption leads to the high forming rate as proposed in both of the above publications EP-A-0194118 and EP-A-0196788.

The method in accordance with the invention is based on the assumption that the occurrence of recovery after a rolling stage may be suppressed by lowering the temperature at which a rolling stage takes place. Then the forming rate may be reduced so far that the rolling speed as regards the amount of rolled steel corresponds to the capacity of a continuous casting machine. By subsequent heat treatment, recrystallisation may be initiated for obtaining a desired r-value. This assumption enables the use of a continuous process for the manufacture of formable steel with a desired r-value. The result is a method which is efficient and safe to operate and which produces a formable steel with homogeneous mechanical properties and easily reproducible quality. Because there are no run-in and run-out phases, the method produces a very high material yield.

It is to be noted that a method for the manufacture of thin steel strip with an improved workability is known from EP-A-0226446, in which continuous cast steel is subjected to a 'lubrication' rolling stage at a temperature of between 300° C. and the Ar3-point at a rolling speed of not less than 1500 m/min. A 'lubrication' rolling stage, i.e. rolling while adding extra lubricant, is known from the practice of hot rolling under the term "strip greasing". In the method of EP-A-0226446 a rolling reduction of not less than 90% is mentioned which, together with the rolling speed of over 1500 m/min, ensures that the deformation in the steel resulting from rolling is uniformly spread across the section of the steel strip. Rolling speeds and thus strip exit speeds of up to 5000 m/min are proposed.

Such high rolling speeds are not compatible with a practical embodiment of a continuous casting machine, and create problems with the other components used, such as coiling mandrels. A problem with high strip exit speeds is that the strip tends to fly so that extra guides are needed which themselves may also damage the strip. Therefore, an apparatus for carrying out rolling processes with high strip exit speeds is complicated and costly. Consequently, operating such an installation economically requires a high production capacity. This means that the proposed method is not suitable for small or medium sized steelworks.

Preferably in the present invention the strip exit speed after rolling is less than 750 m/min. A lower exit speed has the advantage that controlling the shape of the strip and guiding the strip through the installation is simpler. One result is that it is possible to omit the 'crown' in the strip which is needed in conventional hot strip rolling mills for keeping the strip in the centre of the mill train. By 'crown' is meant the slight decrease in thickness of a strip from the edge towards its centre. During rolling in a continuous process with lower exit speed, the strip can be run through the installation by means of drawing and simple steering rollers.

Preferably the rolling comprises a plurality of reduction stages and is carried out partly in a temperature range in which between two successive reduction stages the steel largely recrystallizes and carried out partly in a temperature range in which between two successive reduction stages in principle the steel does not recrystallize. This therefore splits up the temperature range in which the steel is ferritically reduced. This splitting is achieved for instance by placing a cooling installation between one or more mill stands carrying out the reduction. An advantage of this embodiment is that, in the temperature range in which recrystallisation occurs, it is possible to roll with low rolling forces and the rolling forces required to obtain a desired reduction are predictable with great accuracy both in the range in which no recrystallisation takes place, and in the range in which recrystallisation does take place. This makes a precise control of the strip shape possible.

Another advantage is that material properties can be influenced. The exit temperature of the steel strip on leaving the last rolling stage is selected in dependence on the desired r-value. If a low r-value is acceptable, then ferritic rolling may be carried out at a temperature in the range from approx. 650° C. to $T_f$. Then the steel does not need to be annealed specially for recrystallisation. Recrystallisation then comes about through the steel's own heat. For a high r-value, such as is needed for good deep drawing properties, an exit temperature is selected in the range from approx. 300° C. to approx. 650° C. At these low temperatures the recovery process proceeds so sluggishly that sufficient dislocations remain for later recrystallisation.

In a suitable method for carrying out the annealing, the strip is annealed for at least 0.1 seconds at a temperature of between 600° C. and 900° C. and more preferably the strip is annealed for a period from 5 to 60 seconds at a temperature of between 700° C. and 850° C.

In the invention preferably after annealing or after the recyrstallization without annealing, the strip is brought to a temperature below 450° C. This prevents oxide blisters from forming on the surface of the strip. Such blisters damage the surface. Moreover, a pickling process to be carried out later may then be done faster and more efficiently. More preferably the strip is brought to a temperature of between 450° C. and 300° C. and then coiled. This achieves the effect that carbon dissolved in excess mostly disperses in the form of edge cementite which further improves the formability of the formable steel.

If the strip is not coiled immediately but is first pickled, it is preferable that the strip be brought to a temperature below 150° C. before immersion in the pickle liquor comprising hydrochloric acid. Other pickle liquors are known in which a strip may be pickled at higher temperatures, but such pickle liquors are weak acids which would mean that very long pickling tank sections would be needed.

Yet another embodiment of the method in accordance with the invention is characterized in that before coiling the strip is brought to a temperature below 80° C. The strip is then suitable for a supplementary process stage which is characterized in that the strip is re-rolled with a re-rolling reduction of between 0.1% and 10%. By subjecting the strip to re-rolling the strip shape may be improved and the surface roughened. At the same time this prevents flow lines ocurring in the workpiece when the strip is being deep drawn. Before re-rolling reduction it is an advantage for the strip temperature to be below 50° C. because above 50° C. any dissolved carbon remaining moves so fast that the steel of the strip ages. On subsequent press working of the steel, flow lines then occur on the surface which are harmful to the appearance of the pressed part. Re-rolling has the advantage that the mechanical properties of the steel improve, while in addition re-rolling is beneficial for the roughness and makes it possible to correct the strip shape.

The material output may be kept high by a specific embodiment of the method in accordance with the invention which is characterized in that the strip is pickled and by yet another specific embodiment which is characterized in that the strip is provided with a coating layer. This achieves an extra advantage that, for the sake of the application of the coating layer, such as zinc, the strip is taken through an annealing furnace which has a temperature at which recrystallisation occurs. A separate recrystallisation stage may then be avoided.

One preferred embodiment of the method in accordance with the invention is characterized in that, after rolling, the strip is heated to a temperature of between 750° C. and 850° C. and then at a rate of cooling of between 100° C./sec and 1000° C./sec is cooled down to a temperature of less than 450° C. During heating the steel recrystallises, whereupon a 'dual-phase' structure develops in the material, consisting of austenite and ferrite. The ratio of the volume of the austenite phase and the volume of the ferrite phase may be adjusted by selecting the annealing temperature in dependence on, in principle, the carbon content of the steel.

During the fast cooling down, the austenitic phase transforms at approx. 450° C. into a martensitic phase, which is particularly hard. The cooling down rate necessary to accomplish the desired transformation depends on the steel composition, specifically the content in the steel of manganese, silicon, chromium and molybdenum, and in practical applications amounts to 100° C./sec–1000° C./sec. The resulting 'dual-phase' structure of ferrite and martensite produces a material that combines high strength with good formability.

This steel with a 'dual-phase' structure is of itself a known product. With the method in accordance with the invention this product may be manufactured simply and at low cost. The method in accordance with the invention has the advantage that the velocity of the strip is comparatively low. By simple means the strip may be brought from the rolling temperature to the desired heating temperature, and thereafter be cooled quickly to a temperature of approx. 350° C.

A preferred embodiment of the method in accordance with the invention is characterized in that the slab is cooled to a temperature of between 300° C. and a temperature at which at least 90% of the material converts to ferrite. It is found that better results are obtained as more material is converted from austenite to ferrite.

Yet another preferred embodiment of the method in accordance with the invention is characterized in that the slab is pre-reduced and then cooled down to the rolling temperature. Following continuous casting the slab is still at a high temperature and so is to be pre-reduced with comparatively low forces and simple means, for example by forging, pressing or rolling. By pre-reducing the slab at a high temperature, preferably above 1100° C., the total forming energy required is considerably limited. A pre-reduction to a thickness of 5 mm is possible.

The method in accordance with the invention demands a high degree of availability from every component of the apparatus with which it is carried out. In order to prevent production coming to a standstill through one single part becoming defective, it is an advantage to include in the apparatus components for temporary storage in order to allow the method to run on as much as is then possible. In particular, for the apparatus which rolls the cooled slab, it is an advantage to incorporate a so-called coilbox for temporarily storing a slab, whether pre-reduced or not.

The invention will now be illustrated by way of non-limitative example by reference to the drawings. In the drawings, FIG. 1 is a graph showing the qualitative relationship between the rolling temperature at the last rolling stage and the r-value after recrystallisation, and FIG. 2 is an example of the layout of an apparatus for carrying out the method in accordance with the invention.

Figure 2:
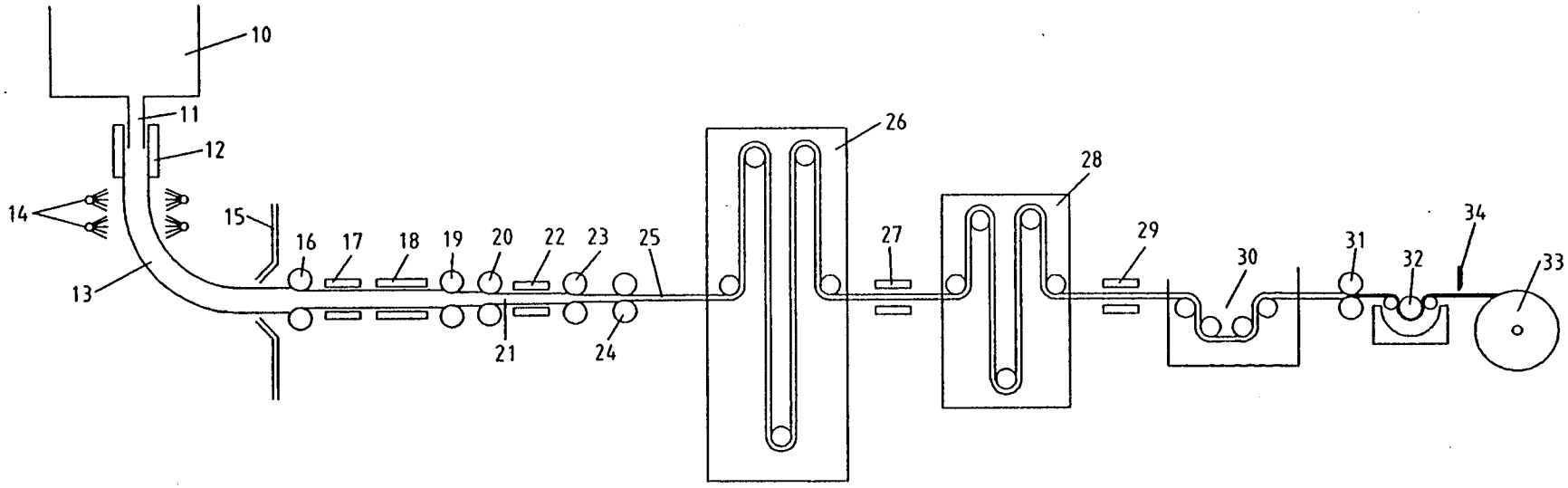

FIG. 1 shows the relationship between the temperature of the strip at the last rolling stage and the r-value of the strip after recrystallisation. The x-axis gives the final rolling temperature in the range from approx. 200° C. to approx. 700° C.; the y-axis gives the r-value after recrystallisation from approx. 1.0 to approx. 2.0. The figure shows three curves for three different combinations of strip speed and forming rate in accordance with the following data:

| Curve | Strip Speed | Forming Rate |
|---|---|---|
| 1 | 200 m/min | 150/sec |
| 2 | 300 m/min | 220/sec |
| 3 | 400 m/min | 300/sec |

From the figure it appears that steel types for which no requirements or minor requirements in r-value are made may be rolled at a high rolling temperature, at which the material recrystallises by its own heat content. However, high r-values may be achieved at comparatively low forming rate and low strip speed by selecting a low rolling temperature and then carrying out recrystallisation annealing.

As curve 1 shows, a high r-value may also be achieved at a low rolling temperature and a forming rate of 150/sec at a strip speed of 200 m/min. At the maximum exit thickness of 1.5 mm this corresponds to a casting rate of 0.3 $m^2$/min. Such a casting rate lies within the range of currently available continuous casting machines. The assumption, as expressed in the set of curves of FIG. 1, makes possible a continuous process and the potential associated advantages in combination with a continuous casting machine as used in practice.

FIG. 2 shows a non-limitative example of an embodiment of an apparatus for carrying out the method in accordance with the invention. FIG. 2 shows a tundish 10 of a continuous casting machine from which steel flows into the mould 12 through a casting pipe 11. The slab 13 emerging from underneath the mould is cooled by means of water sprayers 14 and then turned from a vertical to a horizontal direction by a roller track not shown in drawing. A scale breaker 15 rinses off scale adhering to the slab using water jets. Now de-scaled the slab may then be pre-reduced. In the figure a mill stand 16 is chosen for this. After pre-reduction the slab is cooled by means of the cooling installation 17 and then homogenized in temperature in the homogenizing furnace 18. After the homogenizing furnace the slab has a temperature in the range of between 300° C. and $T_l$, the actual temperature being dependent on the desired r-value in combination with the production speed of the continuous casting machine.

The homogenized slab is then taken into mill stands 19 and 20. Two four-high mill stands may for instance be chosen for this. Care is taken that the rolling temperature at the mill stands 19 and 20 does not lie in the vicinity of 580° C. being the temperature above which the recrystallisation process of steel begins. If the rolling temperature in the mill stands 19 and 20 does lie above 580° C., recrystallisation takes place between the mill stands 19 and 20. The steel sheet 21 emerging from the roll 20 is then cooled by means of cooling installation 22 to a temperature at which no more recrystallisation takes place during rolling. Next the cooled steel sheet 21 is further rolled out by rolls 23 and 24 into a strip 25 with a final thickness of between 0.5 mm and 1.5 mm. After the final roll stand 24 of the hot rolling, the strip speed is less than 1000 m/min. At least one of the roll stands 19, 20, 23, 24 effects a reduction of over 30%. The strip 25 is taken through a heating apparatus 26 for recrystallisation annealing to obtain a desired r-value or for another heat treatment. A cooling installation 27 is positioned after the heating apparatus 26 for cooling the strip 25. The cooling installation 27 has sufficient capacity to cool down the strip 25 so fast that the strip obtains a 'dual-phase' structure, the so-called 'dual-phase'; steel. A second heating apparatus 28 is positioned after the cooling installation for 'overageing' and is followed by a cooling apparatus 29. A pickling line 30 follows the cooling apparatus 29 for the removal of the oxide scale from the strip. A re-roller 31 is available for giving the strip an extra reduction of between 0.1% and 10%. An electrochemical cell 32 may be used for putting a coating layer onto the strip. The coating layer may be for example, a zinc layer, a chromium layer or an oil film. A coiling apparatus 33 is positioned after the electrochemical cell for coiling the finished strip. Using a shearing machine 34 the strip may be cut off to a desired length.

What is claimed is:

1. Method for the manufacture of formable steel in the form of a strip with a final thickness of between 0.5 and 1.5 mm, comprising the following continuous successive process stages:

(i) continuously casting molten steel into a slab of less than 100 mm thickness, (ii) cooling the slab to a hot rolling temperature which is between 300° C. and a temperature $T_l$ at which at least 75% of the steel material is converted into ferrite, (iii) rolling the cooled slab into strip in a hot rolling process comprising at least one reduction stage which has a thickness reduction of over 30%, the strip exit speed after the hot rolling being less than 1000 m/min, (iv) recrystallizing the strip material, and (v) coiling the strip.

2. Method according to claim 1 wherein said strip exit speed after the hot rolling is less than 750 m/min.

3. Method according to claim 1 wherein said hot rolling process comprises a plurality of reduction stages and is carried out partly in a temperature range in which between two successive reduction stages the steel material largely recrystallizes and partly in a temperature range in which between two successive reduction stages the steel substantially does not recrystallize.

4. Method according to claim 1 wherein the step of recrystallizing comprises annealing for at least 0.1 sec at a temperature in the range 600° to 900° C.

5. Method according to claim 4 wherein said annealing is for a period in the range 5 to 60 sec at a temperature in the range 700° to 850° C.

6. Method according to claim 4 including, immediately after said annealing, reducing the strip to a temperature in the range of 450° to 300° C. prior to said coiling.

7. Method according to claim 6 including, immediately after coiling, reducing the temperature of the strip to below 150° C.

8. Method according to claim 6 including, immediately after coiling, reducing the temperature of the strip to below 80° C.

9. Method according to claim 1 including a step, prior to coiling, of pickling the strip.

10. Method according to claim 1 including, after the step of recrystallizing, a step of re-rolling the strip with a rolling reduction in the range 0.1 to 10%.

11. Method according to claim 1 including a step, prior to coiling, of providing a coating on the strip.

12. Method according to claim 1 wherein said recrystallizing step comprises heating the strip to a temperature in the range 750° to 850° C. and then cooling it at a rate in the range 100° to 1000° C./sec to a temperature of less than 450° C.

13. Method according to claim 1 including the step, before said hot rolling step, of cooling the slab to a temperature which is between 300° C. and the temperature at which at least 90% of the steel material is converted into ferrite.

14. Method according to claim 1 including the step, prior to said cooling to the hot rolling temperature, of pre-reducing the slab thickness.

15. Method according to any one of the preceding claims comprising the step of temporary storage of the continuously cast steel.

16. In a method for the manufacture of formable steel in the form of a strip with a final thickness of between 0.5 and 1.5 mm in which, in a number of continuous successive process stages, molten steel is continuously cast into a slab of less than 100 mm thickness and the slab is rolled into the strip, the improvement that the slab is cooled down to a rolling hot temperature of between 300° C. and a temperature $T_t$ at which at least 75% of the material is converted into ferrite, that the hot rolling of the slab into strip comprises at least one reduction stage with a thickness reduction of over 30% and has an exit speed after the hot rolling of less than 1000 m/min, and that after recrystallisation the strip is coiled.

* * * * *